US005538222A

United States Patent [19]

Kataoka

[11] Patent Number: 5,538,222

[45] Date of Patent: Jul. 23, 1996

[54] CHAIN LEVER HOIST

[75] Inventor: Iwao Kataoka, Hyogo, Japan

[73] Assignee: H.H.H. Manufacturing Co., Osaka, Japan

[21] Appl. No.: 448,647

[22] Filed: May 24, 1995

Related U.S. Application Data

[63] Continuation of Ser. No. 64,202, May 20, 1993, abandoned.

[30] Foreign Application Priority Data

Aug. 17, 1992 [JP] Japan ..... 4-241191

[51] Int. Cl.[6] ..... B66D 1/14; B66D 1/30

[52] U.S. Cl. ..... 254/352; 254/357; 254/369; 254/372

[58] Field of Search ..... 254/352, 357, 254/365, 369, 372, 346

[56] References Cited

U.S. PATENT DOCUMENTS

| | | | |
|---|---|---|---|
| 2,417,492 | 3/1947 | Hinchcliffe | 254/369 X |
| 2,453,581 | 11/1948 | Moore | 192/16 |
| 3,047,114 | 7/1962 | Stevens | 192/16 |
| 3,776,514 | 12/1973 | Eggleton, Jr. et al. | 254/369 X |
| 4,420,144 | 12/1983 | Nishimura | 254/357 X |
| 4,468,005 | 8/1984 | Nakamura | 254/352 X |
| 4,469,308 | 9/1984 | Nakamura et al. | 254/357 X |
| 4,474,360 | 10/1984 | Maeda | 254/372 X |
| 4,819,913 | 4/1989 | Nishimura | 254/357 X |
| 5,088,694 | 2/1992 | Nishimura | 254/352 |
| 5,156,377 | 10/1992 | Nishimura | 254/372 X |

FOREIGN PATENT DOCUMENTS

| | | |
|---|---|---|
| 0542815 | 9/1959 | Belgium . |
| 0976683 | 2/1964 | Germany . |

OTHER PUBLICATIONS

H.H.H. chain lever hoist Table No. M-01 (coil spring type) No date AVL.

*Primary Examiner*—Michael R. Mansen
*Attorney, Agent, or Firm*—Thompson Hine & Flory

[57] ABSTRACT

The most commonly used spring type chain lever hoists suffer from a major drawback in that, if the chain is drawn quickly over the load sheave while it is set for free running operation, the brake will automatically be applied and the free running movement terminated. Similarly, if a light load is suspended from the chain, the weight of the load may be insufficient to activate the brake with the result that the load will be wound down dangerously quickly, leading on occasion to accidents. The present invention is designed to resolve these potentially fatal flaws by enabling a hub, which screws freely onto a spindle in the conventional manner, to be rotated through a few degrees into a prescribed lock position relative to the spindle and then locked there either temporarily or permanently as required.

5 Claims, 6 Drawing Sheets

CHAIN LEVER HOIST

This is a continuation of application Ser. No. 08/064,202, filed May 20, 1993, now abandoned.

BACKGROUND OF THE INVENTION

1. FIELD OF THE INVENTION

The invention relates to a chain lever hoist (hereafter "lever hoist") with a load chain and that can be manually operated by means of a lever, for example, to wind goods up or down or to pull them along.

2. DESCRIPTION OF THE PRIOR ART

Generally speaking, this kind of lever hoist must not only to be capable of winding goods up and down (hereafter "winding operation") by means of a lever-operated load chain, but must also allow the chain to move freely under no-load conditions. In other words, it is normally held to be essential that the chain hoist should be provided with what is sometimes called a "load sheave" to allow for the free running of the chain.

Of the conventional types of lever hoist in current use, one of the best known and most commonly used types is structured such that the load sheave, which is fitted to the main framework of the apparatus, is also joined to a spindle to which a fixed friction plate is secured, said spindle also being screwed into a hub incorporating a device for switching between upward and downward winding operations, the part of the spindle between the fixed friction plate and the hub being also fitted with a ratchet gear which has brake linings on both sides and which is able to slide and rotate freely on said spindle such that the distance between said fixed friction plate and said hub can be varied by screwing the hub up or down the spindle in such a way as to squeeze or release said ratchet gear and brake linings, such action being also assisted by the fitting, for example, of a coil spring in extended condition between said fixed friction plate and said hub such that the hub is ordinarily pressed outwards by the force of the coil spring, thereby easing the contact pressure of the hub on said brake linings and, in so doing, preventing the brake from being applied. In lever hoists of the type described above, it is common for a heavy duty hoist with a load capacity of 0.5 tons or more to have its load sheave and spindle linked through the medium of a plurality of reduction gears but for a light hoist with a load capacity of less than 0.5 tons to have its load sheave and spindle connected to each other directly. Spring lever hoists of the type outlined above suffer from a significant drawback, however, in that when the chain is moved quickly while the load sheave is in free running operation, the spindle turns but the hub does not turn with it and, since the spindle and the hub are linked by a threaded connection, the space between the fixed friction plate and the hub is automatically narrowed and the brake applied, thereby eliminating the capacity for free movement. The hub thus has to be rotated manually back each time this happens in order to re-open the gap between the hub and the fixed friction plate and release the brake.

Another problem with the conventional type of spring lever hoist is that, when winding down a light object, the force with which the spindle is being screwed into the hub is sometimes weaker than that with which the coil spring is pressing the hub outwards. In this sort of case, the object being lowered is sometimes let down too quickly and this has in the past led to accidents, some of which have been fatal. In other words, conventional spring lever hoists have what we might call a reciprocal problem in that, if the coil spring is fairly powerfully extended, this will ensure that there is plenty of play in the hub and spindle but there will also be a risk that light objects may be lowered too quickly, leading to accidents. On the other hand, if the spring is only weakly extended, this will help prevent accidents when lowering light objects but, conversely, any rapid movement of the chain while running freely over the load sheave will immediately cause the brake to operate, thus interfering with the free movement of the chain. There are, of course, a variety of mechanisms that can be used to ensure the free running of a load sheave. These include a mechanism whereby, in lever hoists equipped with reduction gears of the type referred to above, the reduction gear spindle can be caused to slide as a means of shifting the gear teeth out of line with each other, thereby permitting the load sheave to rotate freely. Another such mechanism disconnects the pawl from the ratchet gear and this again has the effect of allowing the load sheave to rotate freely. The use of these types of mechanism certainly helps prevent the sorts of problems outlined above but, at the same time, the complexity of these mechanisms can in itself be a source of problems in that the smooth operation of the apparatus is rendered more problematic. There is also a concomitant loss of reliability in that the apparatus tends to break down more often. Moreover, the change from a free running to a winding action always requires a single action.

SUMMARY OF THE INVENTION

The inventors have experimented with a variety of different ways of resolving the sorts of problems outlined above and have eventually come to the conclusion that one answer would be to ensure the free movement of the lever hoist by causing the spindle and the hub to rotate as one, thereby preventing activation of the brake mechanism. The object of the present invention is thus to provide a means of enabling the hub to be rotated manually through just a few degrees in relation to the spindle and then fixed in a prescribed lock position in relation to the spindle, such that the hub does not exert contact pressure on the ratchet gear and brake linings, and then to ensure that the relationship between the spindle and the hub is maintained in this condition, thereby enabling the load sheave to rotate freely. In order to achieve the above object, we made use of a structural configuration whereby the main framework was fitted with a load sheave, in such a way as to enable it to rotate freely, and a spindle, also in such a way as to enable it to rotate freely along with said load sheave. Said spindle was also fitted with a fixed friction plate and was screwed into a hub. A ratchet gear and brake linings were also fitted onto said spindle in such a way as to enable them to slide and rotate freely in between said fixed friction plate and said hub. The main framework was also fitted with ratchet pawls positioned such as to enable them to engage the teeth of said ratchet gear, and a position locking mechanism which enables the hub to rotate through a few degrees away from the winding operation position into a prescribed lock position in relation to the spindle in which it is then be held steady.

The operation of a lever hoist configured in the above manner is such that, if the apparatus is set for upward winding and the winding lever, or similar mechanism, is then used to turn the hub to wind the apparatus upwards, the torque generated by the combination of the weight of the suspended load and the force applied to turn the hub causes the hub to screw on to the spindle and, in so doing, to squeeze the aforementioned ratchet gear and brake linings between the hub and the fixed friction plate such that, if the hub is then turned further in the same direction, the force of the rotation is transmitted from the hub to the ratchet gear and brake linings and from there to the fixed friction plate, the spindle and the load sheave, thereby turning the spindle in such a way that the ratchet gear engages the ratchet pawls and the load sheave is wound upwards. When the apparatus is Wound downwards, on the other hand, although the torque generated by the weight of the suspended load causes the hub to screw onto the spindle, again squeezing the ratchet and brake linings between the hub and the fixed friction plate, if the lever is then used to wind the hub as for a downward winding operation, the torque generated by the rotation of the hub in this case tends rather to offset the force generated by the suspended load and, in so doing, to mitigate the squeezing force with the result that a measure of slippage is secured between the ratchet gear and brake linings on the one hand and the fixed friction plate on the other and the load sheave duly winds down in line with the rotation of the hub. When the apparatus is set to free running operation, the hub is first rotated manually through just a few degrees until it reaches the prescribed lock position, namely the position in which the hub exerts no contact pressure on the ratchet gear and brake linings. At this point, it is then locked by the aforementioned position locking mechanism, which sets the spindle and hub in positions relative to each other in which the brake will not be activated, and this enables the load sheave to be spun freely and quickly without activating the brake.

It is possible, therefore, in the lever hoist of the present invention, to create a space between the fixed friction plate and the hub by shifting the hub into a prescribed lock position in which the contact pressure on the ratchet gear and brake linings is released and then using a position locking mechanism to set the hub in said prescribed lock position such that the spindle and the hub are then held in positions relative to each other in which the brake will not be activated, thereby enabling the apparatus to run freely and steadily without any risk that the brake will be activated before the operation is completed. Again, since, unlike the conventional type of spring lever hoist, there is no coil spring or associated parts maintaining constant outward pressure on the hub, when the aforementioned position locking mechanism is released, the hub will immediately exert contact pressure on the ratchet gear and brake linings with the result that the danger of light loads being wound down dangerously quickly through failure to activate the brake mechanism is completely eliminated. Furthermore, if the holding strength of the position locking mechanism is set to a level less than that of the torque applied to the hub to wind the load chain up, the winding function of the apparatus can be activated simply by initiating the winding action.

DETAILED DESCRIPTION OF THE PREFERRED EMBODIMENTS

Figure 1:
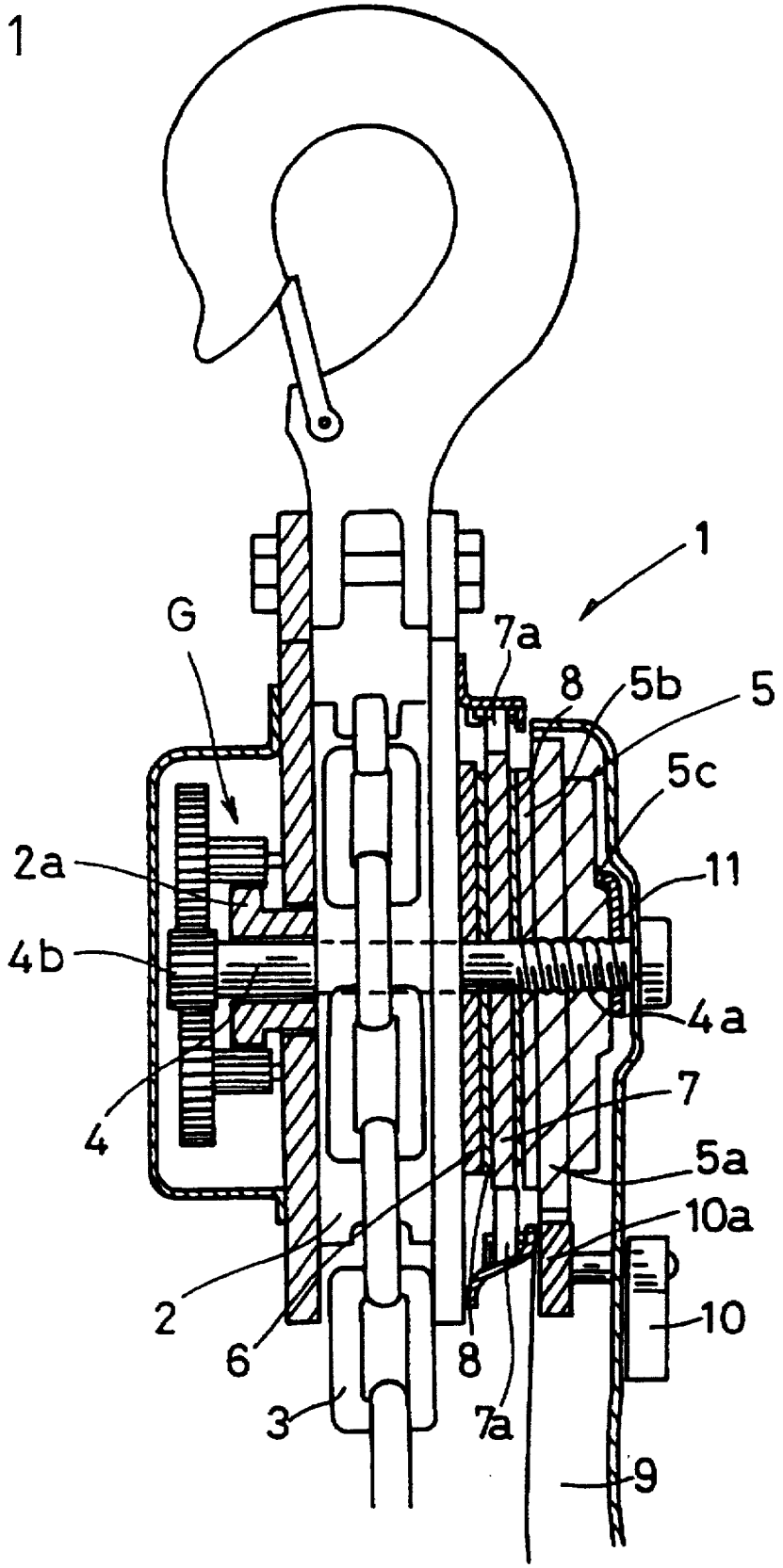
FIG. 1 is a vertical sectional view of the principal mechanism of the first embodiment of the invention.

FIGS. 1 through 5 illustrate the first embodiment of the invention. In FIG. 1, 1 is the main framework, 2 is a load sheave fitted to the main framework 1 in such a way as to enable it to rotate freely, 3 is a load chain Which loops over said load sheave 2, 4 is a spindle which is fitted to the main framework 1 in such a way as to enable it to rotate freely and which also has a threaded section **4*a* at one end and a spindle gear 4*b* at the other end, said spindle gear 4*b* engaging the load sheave 2 gear 2*a* through the medium of a set of reduction gears G. 5 is a disc-shaped hub with a threaded hole in the center into which is screwed the externally threaded section 4*a* of the aforementioned spindle 4. Said hub 5 incorporates a friction plate 5*b*, a switch gear 5*a* and a boss 5*c* on the outer surface. In this case, the outer surface of the hub 5 also acts as a knob to enable the manual rotation of the hub 5. This knob could just as easily be made entirely separate and subsequently fitted to the outer surface of said hub 5. 6 is a fixed friction plate secured to the spindle 4. A ratchet gear 7 and one or more brake linings 8 are mounted in such a way as to allow them to rotate and slide freely on the spindle 4 in between the aforementioned friction plate 5*b* and the fixed friction plate 6. The ratchet gear 7 and the brake linings 8 can be tightened or eased by rotating the hub 5 manually in order to vary the size of the gap between the fixed friction plate 6 and said hub 5**.

Figure 2:
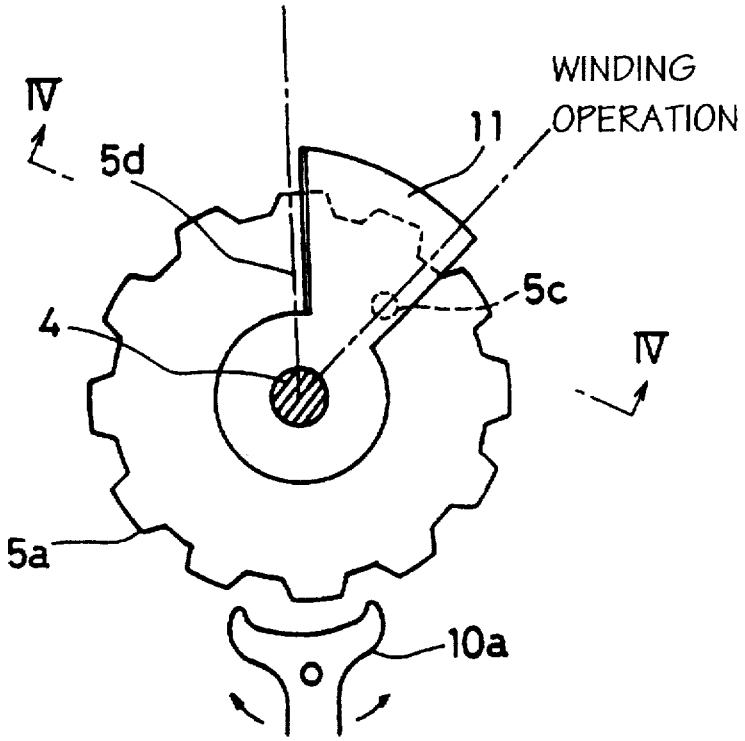
FIG. 2 is a partial front view of the first embodiment of the invention showing the relative positions of the hub, spindle and associated parts during a winding operation.

Also in FIG. 1, **7*a* is a pair of ratchet pawls that are fitted to the main framework 1 and that engage the aforementioned ratchet gear 7, and 9 is a lever that is fitted in such a way that it pivots about the spindle 4. 10 is a knob for switching between a winding operation and a free running operation, which is fitted to the lever 9 in such a way as to enable it to rotate freely and which has a U shaped switch claw 10***a* on its inside end that engages the aforementioned hub 5 at switch gear 5*a*. 11 is a plate spring shaped like a fan, as shown in FIG. 2, and secured to the spindle 4 in such a way that it is able to rotate around said spindle 4, said plate spring 11 and the aforementioned boss 5*c* together comprising a position locking mechanism.

Figure 3:
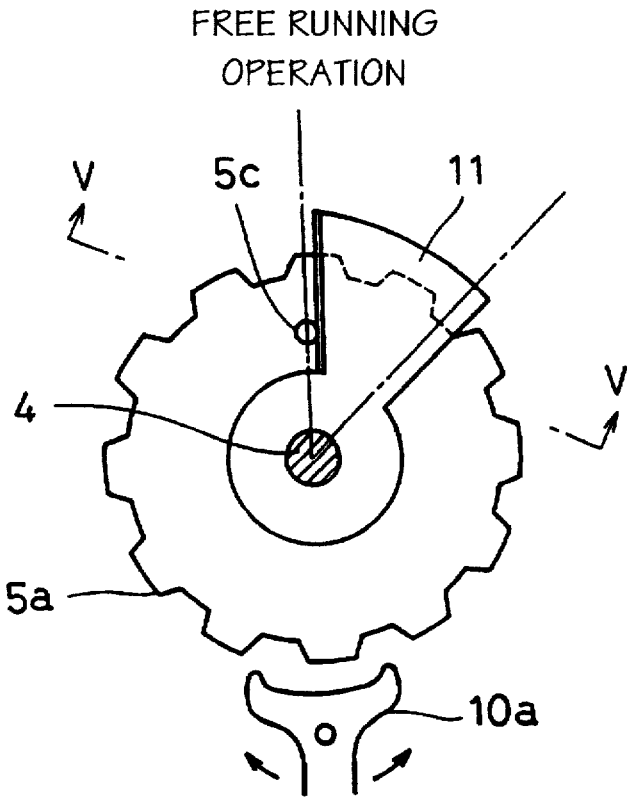
FIG. 3 is a partial front view of the first embodiment of the invention showing the relative positions of the hub, spindle and associated parts when the mechanism is set for free running.
Figure 4:
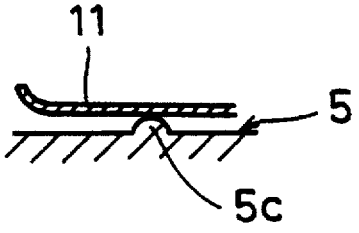
FIG. 4 a sectional view taken along lines IV—IV of FIG. 2.
Figure 5:
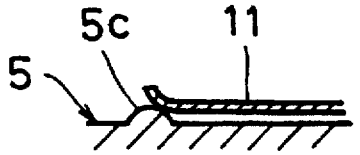
FIG. 5 is a sectional view taken along lines V—V of FIG. 3.

FIG. 2 shows a condition in which the hub 5 has been rotated in a clockwise direction to screw it onto the spindle 4. In this condition, the boss 5*c* makes pressure contact with the plate spring 11, as shown in FIG. 4, in such a way that boss 5*c* is able to slide against said plate spring 11. FIG. 3 shows the hub 5 moved manually counterclockwise through a few degrees and then set at a prescribed lock position. The counterclockwise movement of the hub serves to disengage the boss 5*c* from the plate spring 11, as shown in FIG. 5, and allows it to come to rest against the counterclockwise edge of said spring 11, thereby temporarily preventing the hub from rotating back in a clockwise direction.

Next, we will describe the basic operation of a lever hoist configured in the manner outlined above. When carrying out an upward winding operation, first the aforementioned knob 10 is flipped in a clockwise direction so that the left hand tooth of the switch claw 10*a*, shown in FIG. 2, engages the switch gear 5*a*. If the aforementioned lever 9 is now rotated in a clockwise direction, the combination of the weight of the suspended load and the torque applied by said lever 9 will cause the hub 5 to screw onto the spindle 4 and, in so doing, to squeeze the aforementioned ratchet gear 7 and brake linings 8 between the hub 5 and the fixed friction plate 6. At this point, the boss 5*c* is in pressure contact with the plate spring 11 as shown in FIGS. 2 and 4. If the aforementioned lever 9 is now turned repeatedly in a clockwise direction, the turning force will be transmitted from the hub 5 through the ratchet gear 7, the brake linings 8, the fixed friction plate 6 and the spindle 4 to the load sheave 2 and, as the ratchet gear 7 turns, riding repeatedly up over the ratchet pawls 7*a*, so the load sheave 2 will also rotate and wind up the load chain 3. When carrying out a downward winding operation, on the other hand, first the aforementioned knob 10 is flipped in a counterclockwise direction so that the right hand tooth of the switch claw 10*a*, shown in FIG. 2, engages the switch gear 5*a*. The torque generated by the suspended load will again cause the hub 5 to screw onto the spindle 4 and, in so doing, to squeeze the aforementioned ratchet gear 7 and brake linings 8 between the hub 5 and the fixed friction plate 6. At this point, the boss 5*c* is again in pressure contact with the plate spring 11. However, if the aforementioned lever 9 is now turned repeatedly in a counterclockwise direction, as it turns, the torque generated by the lever 9 will be sufficient to mitigate the squeezing force described above and, in this way, to allow the fixed friction plate 6 on the one hand and the aforementioned ratchet gear 7 and brake linings 8 on the other sufficient freedom to slide against each other, thereby enabling the load sheave 2 to rotate and wind down the load chain 3.

When the chain is to be allowed to run freely over the load sheave, the knob 10 is first set to the neutral position, as shown in FIG. 3. in order to disengage the switch claw 10*a* from the switch gear 5*a* and enable the hub 5 to be manually rotated counterclockwise through a few degrees and temporarily secured in the prescribed lock position. In other words, the boss 5*c* has been disengaged from the plate spring 11, as shown in FIGS. 3 and 5, and has come to rest against the counterclockwise edge of said spring 11, thereby preventing the hub from rotating back in a clockwise direction. In this position, the contact pressure of the hub 5 on the the ratchet gear 7 and the brake linings 8 is eased and the spindle 4 and the hub 5 are held in fixed positions relative to each other, thereby preventing the brake from being applied. This has the effect of allowing the load sheave 2 to rotate freely and, at the same time, of preventing the brake from being applied even if the load sheave 2 is spun round quickly.

Again, since there is no coil spring or associated parts maintaining constant outward pressure on the hub 5, as would be the case with a conventional spring lever hoist, when the temporary lock secured by means of the aforementioned position locking mechanism is released, the hub 5 will immediately reassert contact pressure on the ratchet gear 7 and brake linings 8 with the result that the danger of light loads being wound down dangerously quickly through failure to activate the brake mechanism is completely eliminated. When switching back from a free running operation to a winding operation, if the knob 10 is flipped in a clockwise direction so as to cause the left hand tooth of the switch claw 10*a* to engage the switch gear 5*a* and the aforementioned lever 9 is then wound in a clockwise direction, the torque generated by said lever 9 will exceed the force exerted by the plate spring 11 to prevent the boss 5*c* from moving and said boss 5*c* will force the plate spring 11 upwards, thereby allowing the hub 5 to rotate back in a clockwise direction to return to the condition illustrated in FIG. 2. With the mechanism in this condition, the winding operation can be started immediately.

Next, we will describe the second, third and fourth embodiments of the invention. In these alternative embodiments, the differences from the first embodiment are confined in each case to the position locking mechanism.

Figure 6:
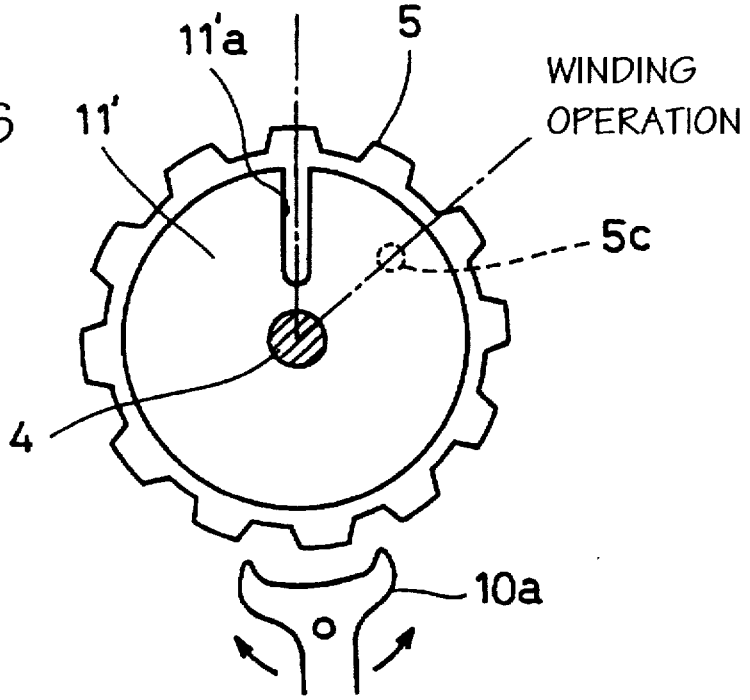
FIG. 6 is a view of the second embodiment of the invention shown during a winding operation, said view corresponding in all other respects to the view of the first embodiment of the invention shown in FIG. 2.

FIG. 6 shows the second embodiment of the invention. In the first embodiment, the plate spring 11 was shaped like a fan pivoting about the spindle. In the second embodiment, by contrast, the plate spring 11' is shaped like a disc centered on the spindle and containing a single narrow groove 11'*a* cut in a radial direction from part way along an imaginary line extending from the center of rotation of the spindle. In other words, FIG. 6 illustrates a condition in which the hub 5 has been screwed in a clockwise direction onto the spindle 4 and the boss 5*c* is in pressure contact with the plate spring 11'. If the hub 5 is then manually rotated counterclockwise through a few degrees, the boss 5*c* slips into the groove 11'*a* in the plate spring 11', thereby preventing the hub 5 from rotating back in a clockwise direction and, in so doing, temporarily locking the hub 5 in its prescribed lock position relative to the spindle 4.

Figure 7:
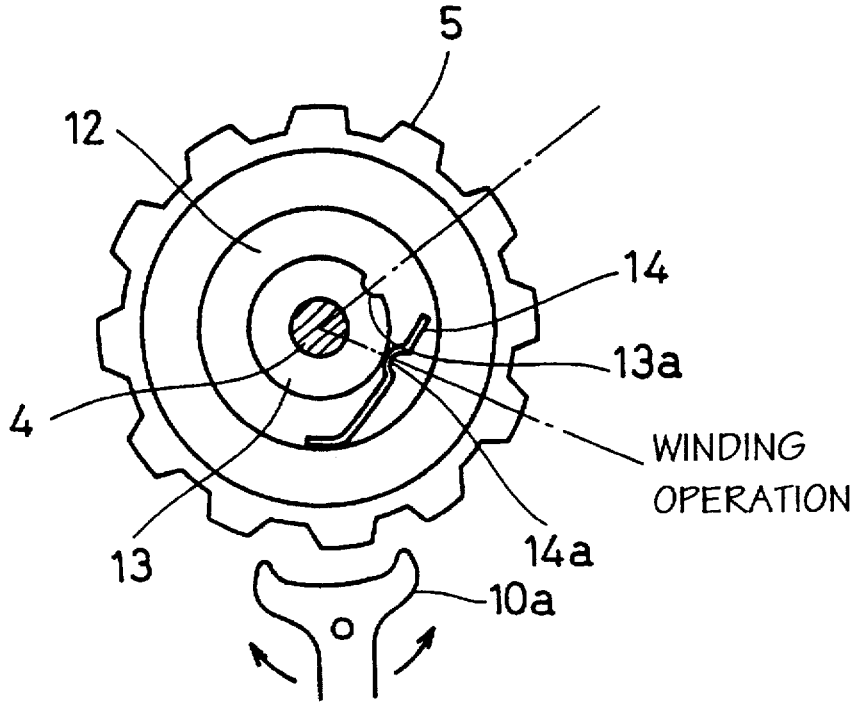
FIG. 7 is a view of the third embodiment of the invention shown during a winding operation, said view corresponding in all other respects to the view of the first embodiment of the invention shown in FIG. 2.
Figure 8:
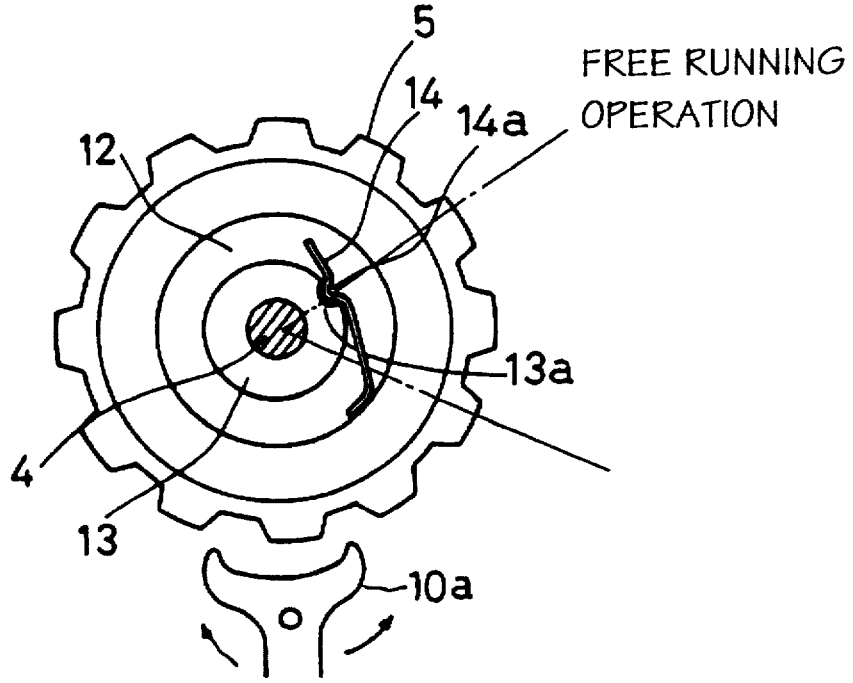
FIG. 8 is a view of the third embodiment of the invention shown when the mechanism is set for free running, said view corresponding in all other respects to the view shown in FIG. 3.

FIGS. 7 and 8 illustrate the third embodiment of the invention. In this embodiment, the outer surface of the hub 5 incorporates an indented section 12 within which a disc 13 is also secured to the spindle 4, the circumference of said disc 13 containing a notch 13*a*. The indented section 12 is also fitted with a bar spring 14 with a U shaped projection 14*a* part way along, said bar spring 14 being secured at one end to the inside circumference wall of the indented section 12 such that the bar spring 14 projection 14*a* presses on the outer edge of the disc 13. FIG. 7 shows the hub 5 screwed onto the spindle 4 in a clockwise direction such that the projection 14*a* is pressing on the outer edge of the disc 13. Next, in FIG. 8, the hub 5 has been manually rotated counterclockwise through a few degrees such that the projection 14*a* has now slotted into the notch 13*a* on the circumference of the disc 13 with the result that the hub 5 cannot now be rotated further and the hub 5 and spindle 4 are thus temporarily locked into their prescribed lock positions relative to each other. For the purposes of the present embodiment, we have assumed that the bar spring 14 is secured at one end only to the inside circumference wall of the indented section 12, but the bar spring 14 could equally be secured in this same way at both ends.

Figure 9:
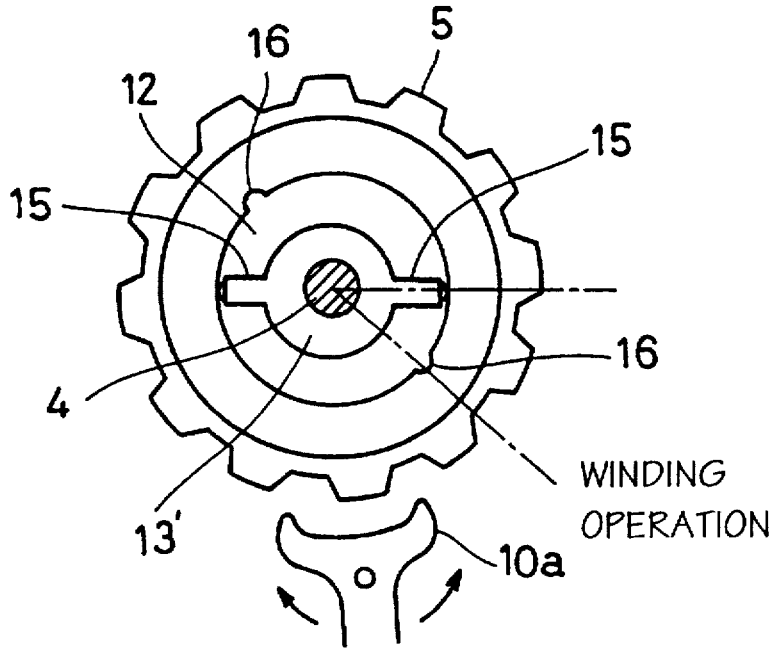
FIG. 9 is a view of the fourth embodiment of the invention shown during a winding operation, said view corresponding in all other respects to the view of the first embodiment of the invention shown in FIG. 2.
Figure 10:
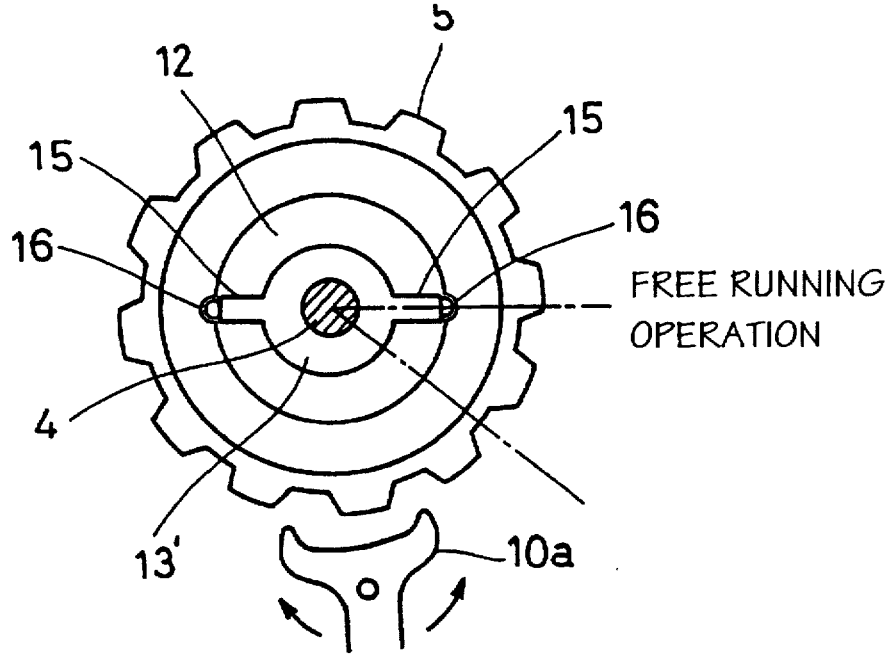
FIG. 10 is a view of the fourth embodiment of the invention shown when the mechanism is set for free running, said view corresponding in all other respects to the view shown in FIG. 3.

FIGS. 9 and 10 illustrate the fourth embodiment of the invention. In this embodiment, the outer surface of the hub 5 incorporates an indented section 12 within which a disc 13' is also secured to the spindle 4, the circumference of said disc 13' being fitted with a pair of cylinders 15,15 projecting outwards from the edge of the disc in diametrically opposite directions. The outer tip of each cylinder 15 is fitted with an ball embedded on the end of a compressed coil spring contained within the main body of each cylinder 15. The inside circumference wall of the indented section 12 incorporates two notches 16,16 also diametrically opposite each other. FIG. 9 shows the hub 5 screwed onto the spindle 4 in a clockwise direction such that the balls embedded in each cylinder 15 are pressing on the inside circumference wall of the indented section 12 of the hub 5. Next, in FIG. 10, the hub 5 has been manually rotated counterclockwise through a few degrees such that the balls embedded in the cylinders 15,15 have now slotted into the notches 16,16 in the indented section 12 with the result that the hub 5 cannot now be rotated further and the hub 5 and spindle 4 are thus temporarily locked into their prescribed lock positions relative to each other.

Figure 11:
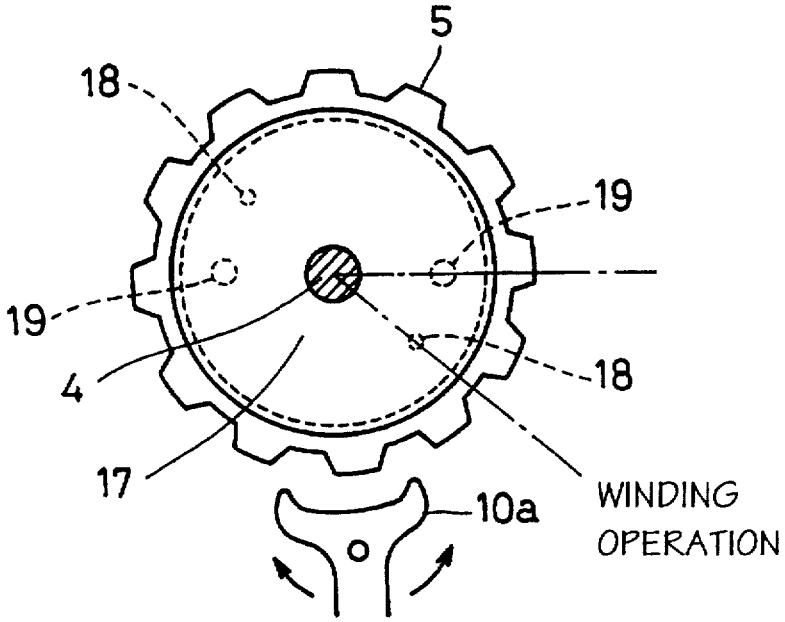
FIGS. 11 is a view of the fifth embodiment of the invention shown during a winding operation, said view corresponding in all other respects to the view of the first embodiment of the invention shown in FIG. 2.
Figure 12:
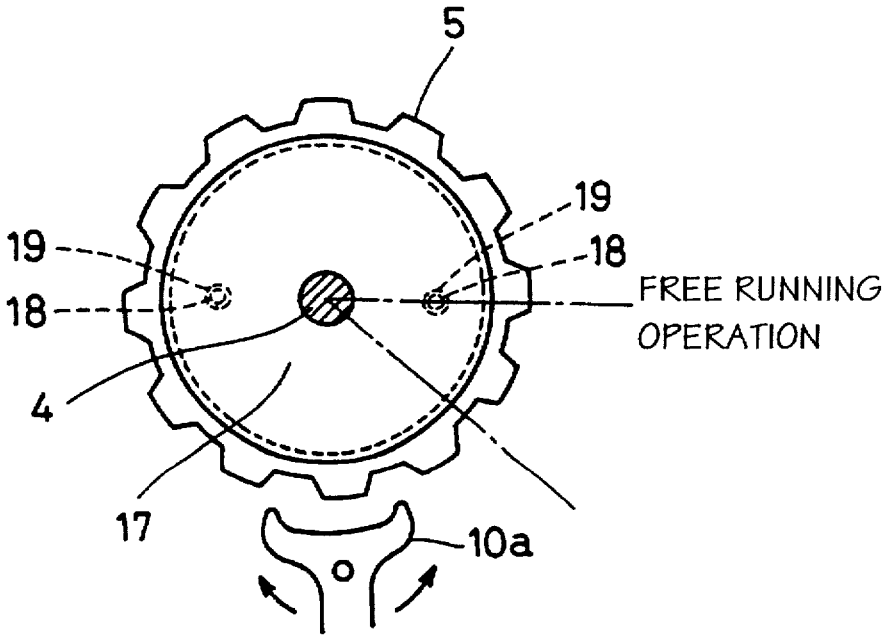
FIG. 12 is a view of the fifth embodiment of the invention shown when the mechanism is set for free running, said view corresponding in all other respects to the view shown in FIG. 3.

FIGS. 11 and 12 illustrate a fifth embodiment of the invention. In embodiments 1 to 4, springs or similar devices were used to hold the hub and spindle temporarily in their fixed positions relative to each other. In the fifth embodiment of the invention, by contrast, when the hub and spindle are shifted into their relative fixed positions, they are then clamped securely into those positions. In other words, in this case, 17 is a cap which is spline jointed in such a way that it can move only in an axial direction in relation to the spindle 4. On the back of said cap 17, there are two rods 18,18 positioned diametrically opposite each other. There are also two holes 19,19 similarly positioned diametrically opposite each other in the side of the hub 5. FIG. 11 shows the hub 5 screwed clockwise onto the spindle 4 in such a way that the rods 18,18 and the holes 19,19 are out of alignment with each other. Next, in FIG. 12, the hub 5 is shown after manual rotation counterclockwise through a few degrees such that the rods 18,18 slot into the holes 19,19, thereby preventing the hub 5 from turning further and effectively securing it firmly in its prescribed lock position in relation to the spindle 4. There is also a Coil spring (not shown in the drawings) fitted in between the hub 5 and the cap 17 such that the cap 17 is constantly being pulled in the direction of the hub 5. The coil spring also acts as a torsion spring in that it is constantly trying to screw said cap 17 round in a clockwise direction. Thus, when the user wants to return the apparatus from a free running operation as shown in FIG. 12 to a winding operation, he needs only pull the cap 17 forward and it will immediately snap back into the winding operation position illustrated in FIG. 11.

As will be clear from the above, one of the essential characteristics of this invention is that, in order to maintain the free running operation of the load sheave 2, it ensures that the positions of the hub 5 and the spindle 4 can be fixed either permanently or temporarily in relation to each other so that they then rotate together in line with the movement of the load chain 3.

One of the merits offered by the first four embodiments of the invention is that, since the position locking mechanism exerts only a fairly weak temporary holding force on the apparatus, any application of a specified level of external force in the form of, for example, the lever 9 torque will be sufficient to break the hold of the locking mechanism and effectively make the apparatus immediately ready for a winding operation.

There is no need for the position locking mechanisms of the invention to be confined to those described in connection with the embodiments outlined above and any mechanism that serves to lock the hub either temporarily or permanently in position after it has been rotated manually through a few degrees into its prescribed lock position would be acceptable. The wide variety of mechanisms that could conceivably serve this sort of purpose has not been illustrated or described in the body of the text. There is equally no reason why the hub and spindle structures of the invention should necessarily be different from conventional hub and spindle structures. The hub, for example, could be structured in accordance with convention and the pitch of the spindle thread could be made to increase gradually in size towards the outer end of the spindle, unlike a conventional spindle. In this sort of case, when the hub is manually rotated along the spindle, it will inevitably catch on the unusually formed part of the spindle and, in this way, become temporarily locked.

What is claimed is:

1. A chain lever hoist comprising:

a main framework;

a load sheave fitted to said main framework in such a way that it rotates along with said load sheave;

a chain capable of being wound around said load sheave;

a spindle fitted to said main framework in such a way that it rotates along with said load sheave;

a first, fixed friction plate secure to said spindle;

a hub screwed onto said spindle;

a ratchet gear and a plurality of brake linings fitted onto said spindle such that they are able to rotate and slide freely between said first, fixed friction plate and said hub;

a plurality of ratchet pawls fitted to said main frame work such that they engage said ratchet tear; and a position locking mechanism that locks said hub during a free running operation into a prescribed lock position in relation to said spindle after said hub has been rotated through a few degrees such that said hub is locked away from said first friction plate and said brake linings, which prevents contact pressure of said hub on said ratchet gear and said brake linings and thereby allowing said load sheave to rotate while preventing a brake form being applied during said free running operation;

wherein said position locking mechanism comprises:

a plurality of notches set into an indented section in an outer surface of said hub, and a plurality of cylinders secured in opposing radial alignment to said spindle, said cylinders each containing an embedded ball and a coil spring pressing said ball outwards from an end of said cylinders, and in which said balls remain out of alignment with the notches in said hub during a winding operation but slip into the notches in the hub during said free running operation, thereby holding said hub temporarily in said lock position in relation to said spindle during said free running operation.

2. The chain lever hoist according to claim 1, further comprising a plurality of reduction gears; such that said load sheave and said spindle are linked through said plurality of reduction gears.

3. The chain lever hoist according to claim 1, in which said hub comprises:

a second friction plate positioned adjacent said plurality of brake linings;

a switch gear positioned adjacent said second friction plate; and a disc-shaped portion of said hub positioned adjacent said switch gear, wherein said disc-shaped portion of said hub functions as a knob, and wherein said second friction plate, said switch gear and said disc-shaped portion of said hub are fixed with respect to each other.

4. The chain lever hoist according to claim 1, in which said brake linings are fitted to both sides of said ratchet gear.

5. A chain lever hoist comprising:

a main framework;

a load sheave fitted to said main framework in such a way that it rotates freely;

a chain capable of being wound around said load sheave;

a spindle fitted to said main framework in such a way that it rotates along with said load sheave;

a first fixed friction plate secured to said spindle;

a hub screwed onto said spindle;

a ratchet gear and a plurality of brake linings fitted onto said spindle such that they are able to rotate and slide freely between said first fixed friction plate and said hub;

a single ratchet pawl fitted to said main framework such that it engages said ratchet gear; and a position locking mechanism that locks said hub during a free running operation into a prescribed lock position in relation to said spindle after said hub has been rotated through a few degrees from a winding operation position, such that said hub is locked away from said first friction plate and said brake lining which prevents contact pressure of said hub on said ratchet gear and said brake linings and thereby allowing said load sheave to rotate while preventing a brake from being applied during said free running operation;

wherein said position locking mechanism comprises:

a notch set into an indented section in an outermost portion of said hub, and a plurality of cylinders secured in radial alignment to said spindle, said cylinders each containing an embedded ball and a coil spring pressing said ball outwards from an end of said cylinder, and in which each of said balls remains out of alignment with the notch in the hub during said winding operation and slips into the notch in the hub during said free running operation, thereby holding said hub temporarily in its prescribed lock position in relation to said spindle.

* * * * *